US006568465B1

(12) United States Patent
Meissner et al.

(10) Patent No.: US 6,568,465 B1
(45) Date of Patent: May 27, 2003

(54) EVAPORATIVE HYDROPHILIC SURFACE FOR A HEAT EXCHANGER, METHOD OF MAKING THE SAME AND COMPOSITION THEREFOR

(75) Inventors: Alan P. Meissner, Franklin, WI (US); Richard G. Parkhill, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/140,349

(22) Filed: May 7, 2002

(51) Int. Cl.[7] ..... F28F 19/02
(52) U.S. Cl. ..... 165/133; 29/890.03
(58) Field of Search ..... 165/133, 165, 165/166, 167, 907; 29/890.03

(56) References Cited

U.S. PATENT DOCUMENTS 4,911,987 A * 3/1990 Sakata et al. ..... 428/469
5,012,862 A * 5/1991 Espeut et al. ..... 165/133
5,079,087 A * 1/1992 Lever et al. ..... 165/133
5,201,119 A * 4/1993 Mizuno et al. ..... 29/890.03
5,514,478 A * 5/1996 Nadkarni ..... 165/133
5,813,452 A * 9/1998 Haruta et al. ..... 165/133
5,916,635 A * 6/1999 Ishii et al. ..... 165/133
6,145,588 A * 11/2000 Martin et al. ..... 165/166
6,245,854 B1 * 6/2001 Obioha et al. ..... 165/133
6,261,706 B1 * 7/2001 Fukuda et al. ..... 165/133

* cited by examiner

*Primary Examiner*—Henry Bennett
*Assistant Examiner*—Terrell McKinnon
(74) *Attorney, Agent, or Firm*—Wood, Phillips, Katz, Clark & Mortimer

(57) ABSTRACT

A heat exchanger/evaporator for transferring heat from a first heat exchange fluid to a liquid to be evaporated into a gaseous second heat exchange fluid that includes a thermally conductive element 30 separating a first flow path 34 for the first heat exchange fluid and a second flow path 36 for the second heat exchange fluid. A first surface is on the element 30 in heat exchange relation with the first flow path 34 and a second surface is on the element 30 opposite the first surface and is in heat exchange relation with the second flow path 36. A hydrophilic coating 50 is bonded on part of the second surface and includes a powder of nominally spherically shaped particles including nickel, chromium, aluminum, cobalt and yttrium oxide bonded together with a braze metal predominantly made up of nickel, chromium and silicon and diffused into the nominally spherically shaped particles and the second surface. Also disclosed is a composition useful in forming a hydrophilic surface and a method of making a heat exchanger/evaporator.

13 Claims, 1 Drawing Sheet

EVAPORATIVE HYDROPHILIC SURFACE FOR A HEAT EXCHANGER, METHOD OF MAKING THE SAME AND COMPOSITION THEREFOR

FIELD OF THE INVENTION

This invention relates to heat exchanger/evaporators, and more specifically, to hydrophilic surfaces employed in heat exchangers to provide improved evaporation. It also relates to compositions for making hydrophilic surfaces and to methods of making a heat exchanger/evaporator.

BACKGROUND OF THE INVENTION

Evaporators come in many types and sizes. In one type of evaporator, a first heat exchange fluid is brought into heat transfer relation with a liquid to be vaporized into a gaseous stream. This type of heat exchanger may be used for humidification purposes where a humidified gas, including air, is required. By way of example only, one instance of the need for a humidifier of this type is in PEM type fuel cell systems. In many such systems, a hydrogen rich gas along with an oxygen rich gas are provided to a fuel cell with membranes separating the anode and cathode sides. Optimal efficiency of operation requires that the fuel and the oxidant therefor be delivered at or above a certain temperature. It is also required that the fuel and oxidant be delivered at a particular relative humidity so as to avoid damage to the membranes as, for example, by drying out.

Thus, heat exchangers of this type are required to evaporate an aqueous material to achieve a desired humidity level in the gaseous stream constituting the hydrogen rich stream and/or the oxygen rich stream. They may also be called upon to elevate the temperature of the streams so that optimal fuel cell efficiency results.

In many instances, particularly in fuel cell systems where size and weight are of concern, it is desirable that the heat exchanger/evaporator be of minimal size and weight. This is true, for example, in vehicular applications of fuel cell systems for traction purposes. It is difficult, however, in many situations to minimize the size of the heat exchanger/evaporator without sacrificing efficiency of humidification or uniformity of humidification.

The present invention is directed to overcoming one or more of the above problems.

SUMMARY OF THE INVENTION

It is a principal object of the invention to provide a new and improved heat exchanger/evaporator for evaporating a liquid, particularly but not necessarily an aqueous liquid, into a gaseous fluid. It is also a principal object of the invention to provide a composition for use in forming a hydrophilic surface for disposition on an evaporative heat transfer surface. It is still a further principal object of the invention to provide a new and improved method of making a heat exchanger that includes an evaporative heat transfer surface.

According to a first facet of the invention, a heat exchanger/evaporator made according to the invention includes a thermally conductive element separating a first flow path for a first heat exchange fluid and a second flow path for a second heat exchange fluid that is typically a gas. A first surface is located on the element in heat transfer relation with the first flow path and a second surface is located on the element opposite the first surface and in heat exchange relation with the second flow path. A hydrophilic coating is bonded on at least part of the second surface and is made up of a powder of nominally spherically shaped particles including nickel, chromium, aluminum, cobalt and yttrium oxide bonded together with a braze metal predominantly made up of nickel, chromium and silicon and diffused into the nominally spherically shaped particles and the second surface to bond them together. The weight ratio of nominally spherically shaped particles to braze metal is in the range on the order of 2–3 to 1.

In a preferred embodiment, the weight ratio is approximately 70:30.

In a preferred embodiment, the element is an imperforate element and has a fin bonded thereto opposite the first surface. The second surface carrying the hydrophilic material is located on the fin.

According to another facet of the invention, a composition for use in forming a hydrophilic surface for disposition on an evaporative heat transfer surface is provided. The composition includes a mixture of a powder of nominally spherically shaped particles including nickel, chromium, aluminum, cobalt and yttrium oxide together with a braze metal powder predominantly made up of nickel, chromium and silicon. The weight ratio of the nominally spherically shaped particles to the braze metal powder is in a range on the order 2–3 to 1. Also included in the composition is a volatizable organic binder that volatizes at temperatures that are sufficiently high to melt the braze metal powder and which will leave substantially no residue.

In a preferred embodiment, the binder is acrylic or polypropylene carbonate based.

According to still another facet of the invention, there is provided a method of making a heat exchanger including an evaporative heat transfer surface and which includes the steps including a step of (a) assembling a heat exchanger core assembly having at least two flow paths, a first for a first heat exchange fluid and a second for a gaseous second heat exchange fluid into which a liquid is to be evaporated. The core assembly includes plural metal components in abutting but unjoined relation. Prior to or after the performance of step (a), the method includes the step of (b) coating at least one component fronting on the second flow path with a composition including a powder of nominally spherically shaped particles including nickel, chromium, aluminum, cobalt and yttrium oxide, a braze metal powder predominantly made up of nickel, chromium and silicon and a volatizable organic binder that volatizes at temperatures sufficiently high to melt the braze metal powder and leave substantially no residue. The weight ratio of the nominally spherically shaped particles to braze metal powder is in a range on the order 2–3 to 1. A further step includes (c) subjecting the core to an elevated brazing temperature to (i) melt the braze metal and cause it to diffuse into the nominally spherically shaped particles and the at least one metal component, (ii) volatize the binder and eliminate substantially all residue thereof, and (iii) braze the metal components into a bonded assembly.

Other objects and advantages will become apparent from the following specification taken in connection with the accompanying drawings.

DESCRIPTION OF THE PREFERRED EMBODIMENT

The invention, and its various facets as mentioned previously, will frequently be described herein in reference to use as a heat exchanger/evaporator for use in humidifying either or both of the fuel stream or oxidant stream in a fuel cell system. However, it is to be understood that use of the invention is not limited to fuel cell systems. Rather, the same may find utility in any application where one heat exchange fluid is brought into heat exchange relation with a second, gaseous heat exchange fluid into which a liquid is to be evaporated. In the usual case, the liquid will be an aqueous material such as water but the invention may be employed with efficacy in the evaporation of nonaqueous materials into a gaseous stream as well. Thus, no limitation to aqueous materials and/or fuel cell systems is intended except insofar as expressed in the appended claims.

Figure 1:
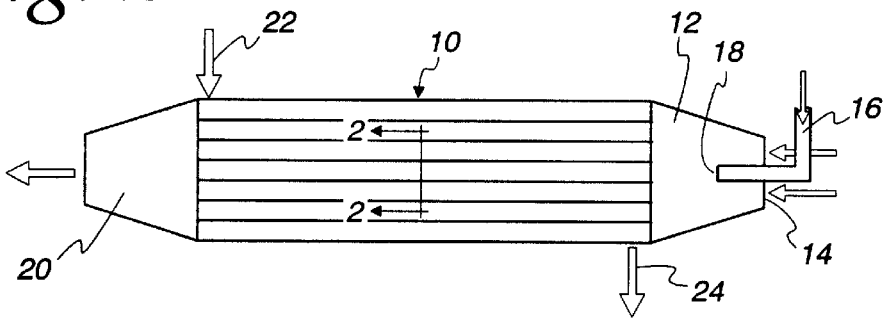
FIG. 1 is a somewhat schematic, elevational view of a heat exchanger/evaporator made according to the invention.

Turning now to FIG. 1, one type of heat exchanger/evaporator made according to the invention is illustrated. The heat exchanger includes a core, generally designated 10, which is made up of a plurality of stacked plates, fins and spacer bars as will be described hereinafter. When utilized in, for example, a fuel cell system, the same may be made up of stainless steel components for corrosion resistance.

A diffuser 12 on one end of the core 10 includes an inlet 14 that receives the gas to be humidified. In the case of a fuel cell system, the gas could be either the fuel, that is, a hydrogen rich stream, or the oxidant, that is, an oxygen rich stream. In either event, a small tube 16 which terminates in a nozzle 18 within the diffuser 12 is provided. An aqueous material, typically water in the case of a fuel cell system, is sprayed into the diffuser 12 to evaporate and humidify the incoming gaseous fuel or oxidant stream.

At the end of the core 10 opposite the diffuser 12, a collector 20 is provided and directs the now humidified gaseous stream to a point of use or further processing.

The core 10 includes internal flow paths for a heat exchange fluid which may be in liquid or gaseous form in heat exchange relation with the flow paths containing the humidified gas for a heat exchange fluid. An inlet therefore is shown schematically by an arrow 22 at an outlet is shown schematically at 24. Preferably, but not always, the flow of the first heat exchange fluid, that is, the stream that rejects heat within the core 10, will be countercurrent to the flow of the second heat exchange fluid, that is, the gaseous heat exchange fluid that is to be humidified.

Figure 2:
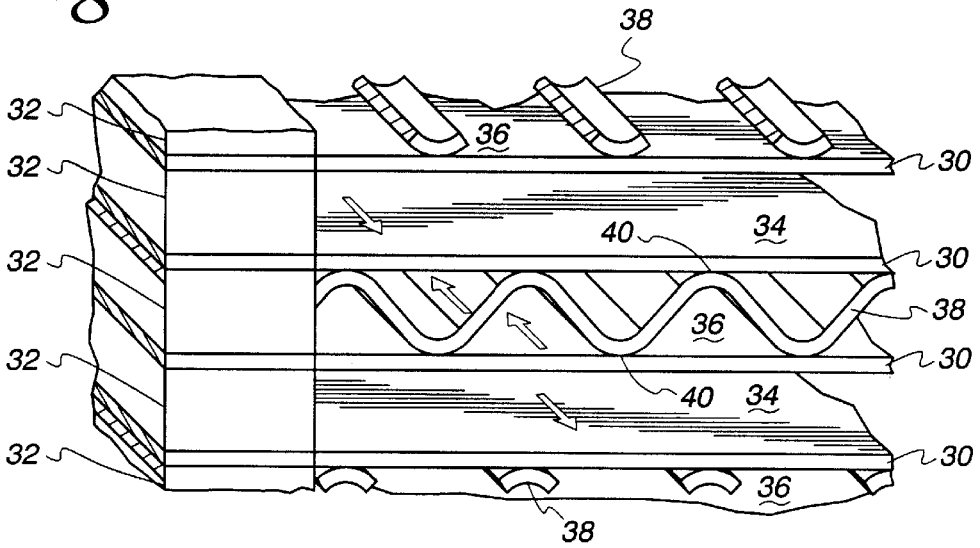
FIG. 2 is an enlarged, fragmentary sectional view of the core of the heat exchanger taken approximately along the line 2—2 of FIG. 1.

Turning now to FIG. 2, the makeup of the core 10 will be described in greater detail. The same includes a plurality of imperforate plates 30 which are spaced at opposed sides by spacer bars 32. The plates 30 define alternating flow paths for the first heat exchange fluid and the second heat exchange fluid. As illustrated in FIG. 2, the first heat exchange fluid flow paths are designated 34, while the second heat exchange fluid flow paths are designated 36. The flow directions in each are indicated by arrows.

Appropriate headering is provided at opposite ends of the cores at the diffuser 12 and collector 20 as is known in the art.

In the embodiment illustrated in FIG. 2, wherein the second fluid flow paths 36 contain the gaseous heat exchange fluid to be humidified, heat exchange and evaporation enhancements are provided in the form of elongated serpentine fins 38. Opposed crests 40 of the fins 38 are bonded as by brazing to the plates 30 defining the flow paths 36, and specifically, the surfaces of the plates 30 which front on the flow paths 36.

The opposite surfaces of the plates 30 face the flow paths 34 and may or may not be provided with enhancements, as desired. Enhancements may include fins, or turbulating dimples or ridges, etc., as is well known in the art.

In a preferred embodiment of the invention, the surfaces of the plates 30 facing the flow paths 36 or the surface of the serpentine fins 38 within the flow paths 36, or both, are provided with hydrophilic surfaces. Consequently, they are easily wetted by water entering with the gaseous stream from the nozzle 18 (FIG. 1) and distribute the water, while in a liquid state, uniformly throughout the passages 36. Considerable improvement in the humidification, in a relatively small volume, is achieved.

Figure 3:
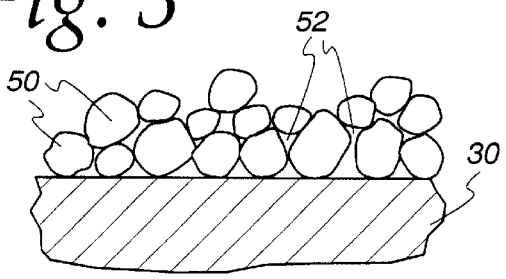
FIG. 3 is a fragmentary, enlarged view of a hydrophilic surface on one component of the heat exchanger.
Figure 4:
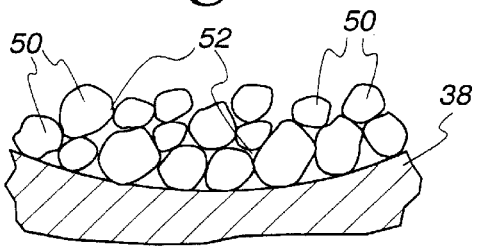
FIG. 4 is a view similar to FIG. 3 but showing the hydrophilic surface on another component of the heat exchanger/evaporator.

As seen in FIGS. 3 and 4 which are basically the same except that FIG. 3 illustrates the hydrophilic surface as applied to one surface of the plates 30 whereas FIG. 4 illustrates the hydrophilic surface as applied to the fins 38, it can be seen that the hydrophilic surface is made up of a plurality of generally spherical particles 50 which may be of varying sizes but generally all are sufficiently small so as to be classified as a powder. The spherical particles 50 are nominally spherical and do not have to be exact spheres. However, it is believed that efficiency of evaporation improves as a true spherical shape is more closely approached.

In any event, the particles 50 are bonded together by a braze metal, also in powder form. The braze metal also bonds the particles 50 to the substrate, i.e., the plates 30 or the fins 38, or both, as the case may be. Because of the shape of the particles 50 a plurality of interconnected interstices 52 between the particles 50 exists; and these interstices provide the hydrophilicity of the coating.

One preferred form of nominally spherical particles is referred to as a ceramic/metal powder commercially available as Metco 461NS. The same includes nickel, chromium, aluminum, cobalt and yttrium oxide as major functional components. The material is understood to have the following composition in weight percent: aluminum 5.5%, cobalt 2.5%, yttrium oxide 0.5%, silicon 1.0%, manganese 2.0%, chromium 17.5%, iron 0.5%, nickel 67.0%, other 3.5%.

The braze metal powder employed to braze the particles 50 to each other and to the substrate 30 or 38 is commercially available as BNi-5 braze powder which is understood to be composed of 19.0 weight percent chromium; 10.2% silicon; and the balance nickel except for trace material including cobalt, carbon, aluminum, titanium, zirconium, boron, phosphorous, sulphur, selenium, molecular oxygen and molecular nitrogen, all at amounts of 0.1% or less.

In general, the ratio of weight percent of the spherical particles 50 to the weight percent of the braze metal powder will be in a range on the order of 2–3 to 1. In a preferred embodiment, the weight ratio is approximately 70:30 of spherical particles 50 to braze metal powder. One such embodiment contemplates a 69:31 ratio.

The braze metal powder is such that it is activated at brazing temperatures at which the various metal components of the core 10, namely, the plates 30, the spacer bars 32 and the fins 38 are brazed together. Consequently, a coating composition containing a mixture of the spherical particles, the braze metal powder and a binder may be applied in an uncured state to the surfaces of the plates 30 fronting on the passages 36 or the fins 38, or both, in an uncured state, the core 10 assembly then placed in jigs or fixtures in the usual fashion to hold the unjoined components together, and then subjected to brazing temperatures. To enhance the strength of the brazed joint and promote uniformity of stack up dimensions, the coating is removed or otherwise made not present on the crests of the fins. The brazing temperatures will then perform three functions, namely, braze the metal components together in assembled relation, cause the brazed metal powder to bond the spherical particles 50 to each other and to their substrate 30 and 38 and volatize the binder. In the usual case, excellent bonding will be achieved because the braze metal powder, when melted, will diffuse into both the particles 50 and the substrates 30,38 and provide an excellent bond. In the usual case, the composition defined by the mixture of the ceramic/metal powder and the braze metal powder is held in place on a substrate prior to brazing through the use of an organic binder. The organic binder is such that it volatilizes virtually completely at or somewhat below the melting temperature of the braze metal powder. Consequently, no residue of the organic binder to speak of remains to interfere with the hydrophilicity provided by particles 50 and the interstices defined thereby.

In the usual case, a target fin surface loading of about 150–200 grams per square meter is preferred. However, higher loading may be tolerated. In some cases, lower loadings may also be tolerated depending upon the degree of hydrophilicity desired.

It is desired that the load be consistently applied by a dipping process to result in a thickness of about 0.001 inches–0.0015 inches on both sides of the fin. It is further desired that the coating application be such that it is non-obtrusive to the flow of aqueous humidifying material and reactive gas through the fins, which is to say that less than 10% of the fin channels on one side are plugged by the coating, to reduce pressure drop.

It is also desired that the crests of the fins, that is, the crests 40 where the strip forming the fin reverses direction to provide the undulating fin, be nonobtrusive to assembly which is to say that the same will metallurgically bond firmly to the adjacent plate 30 to assure good heat conduction between the fin 38 and the plates 30. This requires that the exterior surfaces, that is, the convex surfaces of the crests 40 of the fin be completely uncoated.

To obtain the foregoing, a fin section is degreased and may be weighed off line. Thereafter, the fin section is submerged in a slurry of continuously mixed hydrophilic coating composition (metal/ceramic powder, braze metal powder, and binder). The fin section is then removed from the slurry and allowed to drain momentarily. This is followed by flowing a light current of air over the fin to distribute the slurry consistently over the depth of the fin. After that has occurred, the fin peaks, that is, the crests 40, and specifically the exterior sides thereof, are wiped clean of slurry. This can be accomplished by a rag or, if desired, by sanding after the slurry is dried.

Assuming that the cleaning of the fin peaks or crests 40 has occurred before the drying of the slurry, the fin sections may then be dried at 110° C. and the weight checked to assure that the desired loading has been obtained.

The foregoing sequence of steps is not intended to be limiting, but rather, to disclose the best mode of coating application presently contemplated by the inventors.

It is noted that in some cases, the slurry can be sprayed on or rolled onto the fin but dipping is preferred.

The organic binder is not particularly critical. The same should be used in sufficient quantity that adhesion prior to final assembly of the humidifier is not compromised. Usually, a binder content equal to about 20–23% of the total weight of the coating mixture will achieve this goal. At the same time, the binder should be one that will totally thermally degrade, with virtually no residue, at the brazing temperatures of concern as, for example, a temperature of 600° C. for a stainless steel construction. Furthermore, when the coating is applied by dipping, the slurry should have a viscosity in the approximate range of 2–3 centipoise at 70° F. (with the powders in full suspension within the binder) so as to achieve the desired loading of the powders when applied by dipping, even after the slurry has had an opportunity to partially run off the fin after dipping. Of course, other viscosities might be appropriate where the coating is applied by means other than dipping as, for example, spraying or rolling. Materials such as acrylics, polypropylene carbonates, propyleneglycol mono-methylether acetate and other acetates, and n-propyl bromide, and mixtures thereof are generally satisfactory for the binder. An acrylic based binder is preferred.

It has been found that the particular weight ratio of nominally spherical particles 50 to braze metal power within the above range, and even more specifically, at an approximate 70:30 ratio provides an ideal combination of strength and hydrophilic properties. If a lesser quantity of braze metal is employed, for the same weight of the composition, greater hydrophilicity will be obtained because of the greater number of the particles 50 in the coating. However, the lesser amount of braze material means that the strength of bonding will be reduced which may, depending upon usage, adversely affect the life of the heat exchanger/evaporator. Conversely, when the proportion of braze metal powder is increased, for the same weight of the composition applied to a given surface area, there will be fewer of the nominally spherical particles 50 in the final coating and hydrophilicity will be reduced somewhat. Thus, an outstanding feature of the invention is the permanent adhesion of the coating to its substrate as an integral part thereof. Indeed, it has been found that in instances where the coating is formed and brazed on a substrate prior to placing the substrate within a heat exchanger, it is possible to form a heat exchange enhancement such as dimples or ridges in the plates after application of the hydrophilic surface without any loss of adhesion thereof. In fact, it is possible that in such a case, the substrate may itself fracture before adhesion of the hydrophilic surface is lost.

The nominally spherical particles 50 may vary somewhat from those described previously with specificity. They may be formed by gas atomization or any other suitable means that will result in small nominal spheres. The size of the spheres does not particularly affect hydrophilicity so long as the particles are sufficiently small that the interstices 52 formed between the particles 50 are of capillary size with respect to the liquid that is to be evaporated within the heat exchanger/evaporator.

The shape of the braze metal powder particles is of no moment since the braze metal melts and actually diffuses into the metal ceramic particles and the substrate as mentioned previously.

A substantial criteria for the material of which the particles 50 is formed is that the same have corrosion resistant compatibility with the materials, i.e., gas stream and liquid to be evaporated, into which will come in contact. The material should also remain gettable over a substantial period of time and provide for good adhesion and water retention. Oxidation of the particles is highly undesirable.

The specific use of a metal/ceramic powder plus the braze metal is highly desirable since the nominally spherical particles 50 are considerably more inert than would be the case if metal particles were used in their entirety.

From the foregoing, it will appreciated that the invention is ideally suited for use in heat exchanger/evaporator application in its various facets, including as a heat exchanger/evaporator, as a composition for providing a hydrophilic surface in a heat exchange or evaporation application and as used in a method of making a heat exchanger/evaporator.

What is claimed is:

1. Apparatus for transferring heat from a first heat exchange fluid to a liquid to be evaporated into a gaseous second heat exchange fluid, comprising:

a thermally conductive element separating a first flow path for the first heat exchange fluid and a second flow path for the second heat exchange fluid;

a first surface on said element in heat exchange relation with said first flow path;

a second surface on said element opposite said first surface and in heat exchange relation with said second flow path; and a hydrophilic coating bonded on at least part of said second surface and made up of a powder of nominally spherically shaped particles including nickel, chromium, aluminum, cobalt and yttrium oxide bonded together with a braze metal predominantly made up of nickel, chromium and silicon and diffused into the nominally spherically shaped particles and said second surface, the weight ratio of nominally spherically shaped particles to braze metal being in a range on the order of 2–3 to 1.

2. The apparatus of claim 1 wherein said weight ratio is approximately 70:30.

3. The apparatus of claim 1 wherein said element is an imperforate element having a fin bonded thereto opposite said first surface and said second surface is on said fin.

4. A composition for use in forming a hydrophilic surface for disposition on an evaporative heat transfer surface, comprising a mixture of:

a powder of nominally spherically shaped particles including nickel, chromium, aluminum, cobalt and yttrium oxide and a braze metal powder predominantly made up of nickel, chromium and silicon, the weight ratio of nominally spherically shaped particles to braze metal powder being in a range on the order of 2–3 to 1, and a volatizable organic binder that volatizes at temperatures that are sufficiently high to melt said braze metal and leaves substantially no residue.

5. The composition of claim 4 wherein said weight ratio is approximately 7:3.

6. The composition of claim 5 wherein said binder is acrylic or polypropylene carbonate based.

7. A method of making a heat exchanger including an evaporative heat transfer surface, comprising:

(a) assembling a heat exchanger core assembly having at least two flow paths, a first for a first heat exchange fluid and a second for a gaseous second heat exchange fluid into which a liquid is to be evaporated, said core assembly including plural metal components in abutting but unjoined relation;

(b) prior to or after the performance of step (a), coating at least one component fronting on said second flow path with a composition including a powder of nominally spherically shaped particles including nickel, chromium, aluminum, cobalt and yttrium oxide, a braze metal powder predominantly made up of nickel, chromium and silicon and a volatizable organic binder that will volatize at temperatures sufficiently high to melt the braze metal powder and leave substantially no residue with the weight ratio of nominally spherically shaped particles to braze metal powder being in a range on the range on the order of 2–3 to 1;

(c) subjecting the core to an elevated brazing temperature to (i) melt the braze metal and cause it to diffuse into the nominally spherically shaped particles and said at least one component, (ii) volatize the binder and eliminate substantially all residue thereof, and (iii) braze said components into a bonded assembly.

8. The method of claim 7 wherein said weight ratio is approximately 7:3.

9. The method of claim 7 wherein said binder is acrylic or polypropylene carbonate based.

10. A method of making a heat exchanger including an evaporative heat transfer surface, comprising:

(a) assembling a heat exchanger core assembly having at least two flow paths, a first for a first heat exchange fluid and a second for a gaseous second heat exchange fluid into which a liquid is to be evaporated, said core assembly including plural metal components in abutting but unjoined relation;

(b) prior to or after the performance of step (a), coating at least one component fronting on said second flow path with a composition including a powder of nominally spherically shaped metal and/or ceramic particles, a braze metal powder and a volatizable organic binder that will volatize at temperatures sufficiently high to melt the braze metal powder and leave substantially no residue with the weight ratio of nominally spherically shaped particles to braze metal powder being in a range on the range on the order of 2–3 to 1;

(c) subjecting the core to an elevated brazing temperature to (i) melt the braze metal and cause it to diffuse into the nominally spherically shaped particles and said at least one component, (ii) volatize the binder and eliminate substantially all residue thereof, and (iii) braze said components into a bonded assembly.

11. The method of claim 10 wherein said braze metal powder is predominantly nickel, chromium and silicon.

12. The method of claim 10 wherein said nominally spherically shaped particles include nickel, chromium, aluminum, cobalt and yttrium oxide.

13. The method of claim 10 wherein said binder is acrylic or polypropylene carbonate based.

* * * * *